US006533993B2

(12) United States Patent
Ress

(10) Patent No.: US 6,533,993 B2
(45) Date of Patent: Mar. 18, 2003

(54) VARIABLE HEIGHT LINER SYSTEM

(75) Inventor: Edward J. Ress, Youngstown, OH (US)

(73) Assignee: Fireline, Inc., OH (US)

( * ) Notice: Subject to any disclaimer, the term of this patent is extended or adjusted under 35 U.S.C. 154(b) by 0 days.

(21) Appl. No.: 09/871,418

(22) Filed: May 31, 2001

(65) Prior Publication Data

US 2002/0180125 A1 Dec. 5, 2002

(51) Int. Cl.[7] ..... C21B 3/00

(52) U.S. Cl. ..... 266/275; 266/286; 432/262; 432/264

(58) Field of Search ..... 266/280, 286, 266/275; 432/262, 264

(56) References Cited

U.S. PATENT DOCUMENTS

| | | | | | |
|---|---|---|---|---|---|
| 449,803 | A | * | 4/1891 | Nimmo | 432/262 |
| 777,725 | A | * | 12/1904 | Fox | 266/275 |
| 1,358,816 | A | * | 11/1920 | Bellis | 432/264 |
| 1,482,887 | A | * | 2/1924 | Collins | 432/262 |
| 2,543,700 | A | * | 2/1951 | Leitten et al. | 266/275 |
| 3,162,710 | A | | 12/1964 | Anderson | |
| 4,931,415 | A | | 6/1990 | Neudeck et al. | |
| 5,810,907 | A | | 9/1998 | Okada et al. | |

FOREIGN PATENT DOCUMENTS

| | | | | |
|---|---|---|---|---|
| FR | 2589562 | * | 5/1987 | 432/262 |
| IT | 586681 | | 12/1958 | |

* cited by examiner

*Primary Examiner*—Scott Kastler
(74) *Attorney, Agent, or Firm*—H. Jay Spiegel

(57) ABSTRACT

A melting liner for an induction melting furnace includes an integral foot portion for locating a lip portion of the melting liner in a convenient position for pouring molten metal.

8 Claims, 4 Drawing Sheets

VARIABLE HEIGHT LINER SYSTEM

BACKGROUND OF THE INVENTION

1. Field of the Invention

The invention relates to the art of induction melting of metals and alloys. The invention is directed to a melting liner or crucible used in conjunction with a backup crucible in an induction melting furnace.

2. Description of Related Art

In induction melting furnaces, a melting liner is used to hold metals during a melting process. A backup crucible surrounds the melting liner for safety purposes. If there is a failure in the melting liner, the backup crucible captures any molten metal that may escape the melting liner, thereby protecting the induction furnace from damage. The melting liner and backup crucible are manufactured and used as matched sets.

The backup liner is cemented into the induction furnace and a matched melting liner is inserted into the backup crucible. The melting liner is matched to the backup crucible in the sense that the melting liner must protrude a predetermined distance beyond the backup liner. Additionally, the melting liner should be received within the backup crucible with a minimum of play, or space, between the melting liner and the backup crucible. The melting liner must protrude a specified distance above the backup liner to permit an uncontaminated, free flowing pour, of the molten metal out of the liner and into, for example, a mold. If the molten metal makes contact with the backup crucible, undesirable inclusions may be introduced into the metal. Additionally, metal contact with the backup crucible can disrupt the direction and flow characteristics of the molten metal into the mold, causing, for example, dangerous and wasteful spills. The predetermined protrusion distance, or the height differential between the top of the backup crucible and the top of the melting liner is referred to as the "free lip" distance.

When the mold capacity and/or the alloy to be melted changes, the melting liner must be changed to accommodate the larger/smaller charge weight and/or to eliminate the possibility of metal contamination from one alloy to another. Mold capacity fluctuates from ounces to hundreds of pounds. The alloys used vary widely. To accommodate the new melting liner, a matching backup crucible is also installed. For example, in order to achieve a proper free lip dimension when a shorter melting liner is used, the existing backup crucible is removed and a new backup crucible of the proper height is installed that corresponds to the reduction in height of the melting liner. The removal of the old backup crucible and installation of the new backup crucible is a time consuming task that can take up to 8 or more hours to complete. It is desirable to eliminate this labor expense. Furthermore, backup crucible changeovers interrupt production. The reduction in profits due to lost production can be even more significant than the changeover labor costs. Therefore, production managers are pressured to reduce the frequency of changeovers. Consequently, long production runs of the same capacity molds and/or alloy are scheduled. This means that product is stored in warehouses rather than being manufactured "just in time" for delivery to a customer. Warehousing a product is expensive. Additionally, one risks producing product than may never be sold. Therefore, there are also pressures to produce product on a just-in-time basis.

An alternative to changing out the backup liner is to use an appropriately sized pedestal placed in the bottom of the backup crucible. For example, the pedestal raises the height of a small melting liner in order to provide the required free lip dimension. A different pedestal is required for each melting liner size to maintain the proper free lip distance. Although more cost effective than backup crucible removal, the use of pedestals is cumbersome in practice. Pedestal use involves stocking and inventorying additional components (the pedestal), selecting the correct pedestal for each new melting liner and installing and aligning the pedestal. Additionally, pedestals tend to fall out of the backup crucible at the end of a pour, adding to the risk of mold disruption. In general, pedestal use is found to be so cumbersome, that the most common practice is to change the backup crucible instead of using pedestals.

BRIEF SUMMARY OF THE INVENTION

In order to reduce change over labor and downtime, a new liner system has been developed. The new liner system includes a melting liner operative to hold a charge of metal and to be received within a backup crucible of an induction melting furnace. The melting liner comprises a basin portion sized appropriately for an intended size charge, and an integral foot portion sized to hold a lip of the basin portion in a predetermined position relative to a lip of the backup crucible.

When the required mold capacity and/or the alloy to be processed changes, a backup liner in the furnace is not removed. Instead, only an old melting liner is removed. An appropriately sized melting liner with an appropriately sized integral foot or integral pedestal is then received within the backup crucible.

One advantage of the present invention resides in a reduction in production downtime needed to remove and replace the backup crucible, or retrieve and install an appropriate pedestal.

Another advantage of the present invention is a reduction in change over labor costs.

Yet another advantage of the present invention is found in productivity and manufacturing flexibility enhancement, which eliminates the need for long mold runs.

Still other advantages of the present invention will be apparent to those of ordinary skill in the art upon reading and understanding the following detailed description and viewing drawings associated therewith.

BRIEF DESCRIPTION OF THE SEVERAL VIEWS OF THE DRAWINGS

The invention may take form in various components and arrangements of components, and in various steps and arrangements of steps. The drawings are only for purposes of illustrating preferred embodiments, they are not to scale, and are not to be construed as limiting the invention.

DETAILED DESCRIPTION

Variable height melting liners and a backup crucible are manufactured and used as variable matched sets. The number of combinations is infinite.

Figure 1:
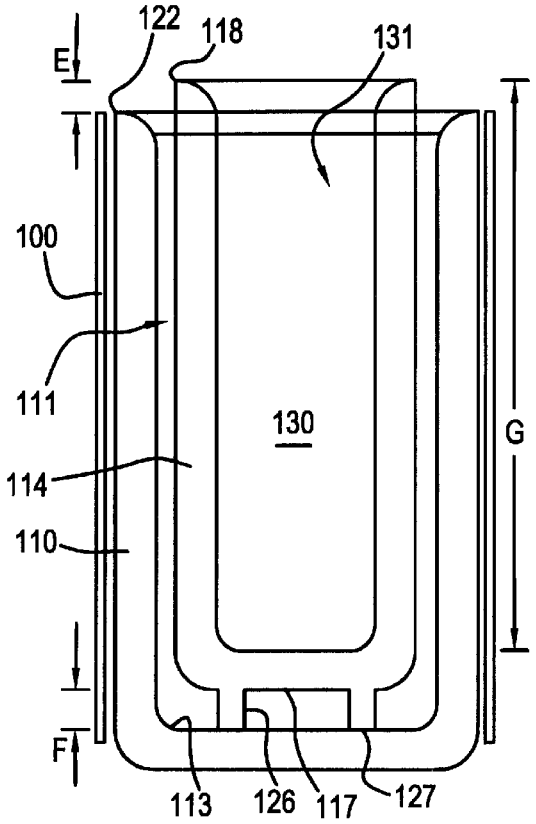
FIG. 1 is an elevation view of a melting liner with an integral foot portion, and a backup crucible.

Referring to FIG. 1, a backup crucible or liner 110 is cemented into an induction furnace 100 and a matched melting liner or crucible 114 is inserted into or received within the backup crucible 110. The melting liner 114 is matched to the backup crucible in the sense that the melting liner 114 is designed so that a first lip 118 of the melting liner 114 protrudes a predetermined free lip dimension E above a second lip 122 of the backup crucible 110, to permit an unontaminated, free flowing pour of the molten metal out of the liner. As explained above, if the free lip dimension E is, for example, too short, during a pour molten metal may contact the backup crucible 110. Metal contact with the backup crucible is to be avoided because con tact with the backup crucible may introduce inclusions and can disrupt the flow characteristics of molten metal (not shown) as it is poured into, for example, a mold (not shown). The free lip dimension E is effected by a variable foot height F of a foot portion 126 of the melting liner 114. The free lip dimension E is also effected by a variable basin height G of a basin portion 130 of the melting liner 114. For example, as the basin height G is reduced to better accommodate a smaller charge, the foot height F may be increased a related amount in order to provide an appropriate free lip dimension E. For instance, if the basin height G is decreased six inches the foot height may be increased six inches in order to maintain the lip dimension E. Alternatively, if the alloy being processed is to be changed, and the new alloy has pouring characteristics that are different than those of the current alloy, the basin height i may be, for example, changed by five inches, while the foot height F may be changed by eight inches. The resulting change in the free lip dimension E may better accommodate the pouring characteristics of the new alloy. The dimensions given are for illustrative purposes only. Any dimension al combinations may be used and still remain within the scope of the invention.

The foot portion 126 of the melting liner 114 is used to regulate the free lip dimension. The foot portion 126 is cast as an integral part of the melting liner 114. The foot portion 126 is not a detachable part. The foot portion 126 is therefore in stark contrast to prior art pedestals. The foot portion 126 eliminates the need to stock, retrieve and install a second component. Additionally, the foot portion 126 does not pose a risk of falling out at the end of a pour separately from the basin portion. The foot portion 126 can be of an y length, width, height, position or shape.

Figure 2:
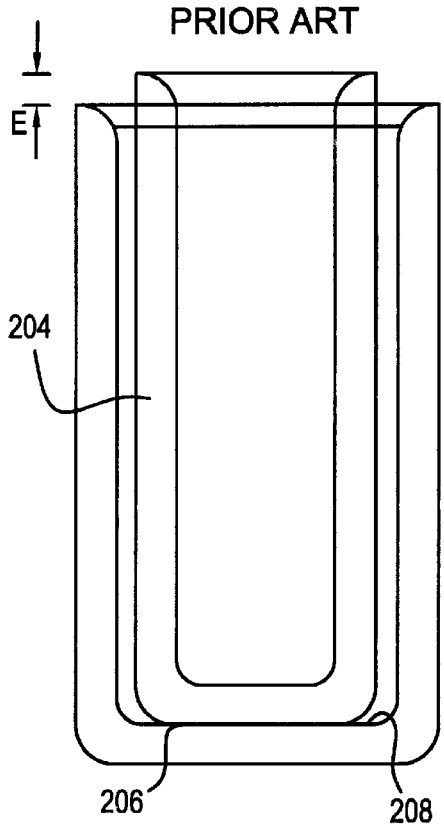
FIG. 2 PRIOR ART
FIG. 2 is an elevation view of a prior art melting liner and backup crucible.

Referring to FIG. 2, in contrast to the melting liner 114 of FIG. 1, a prior art melting liner 204 has no foot portion. Instead, a melting liner bottom 206 rests directly on an inner surface 208 of a backup crucible 210.

Integral foot portions are designed based on a number of factors. These design factors include, design load, material cost, manufacturability, and durability. For example, some designs are better when the foot portion is short, other designs are better when the foot portion is long. The success of a foot design depends to some degree on a manufacturer's skills and equipment, and the refractory materials used. Some trial and error may be required to determine an optimum foot design for a given melting liner size and shape and production method. Some possible foot portion configurations are described below.

Figure 3A:
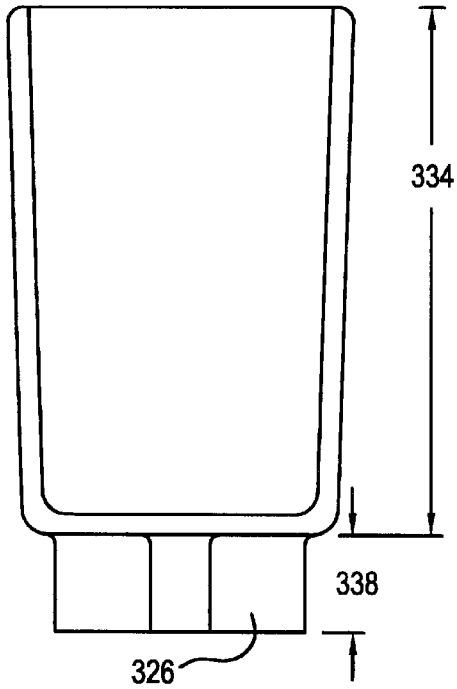
FIGS. 3*a* and 3*b* are an elevation and bottom view of a melting liner having a Y-shaped foot portion.
Figure 3B:
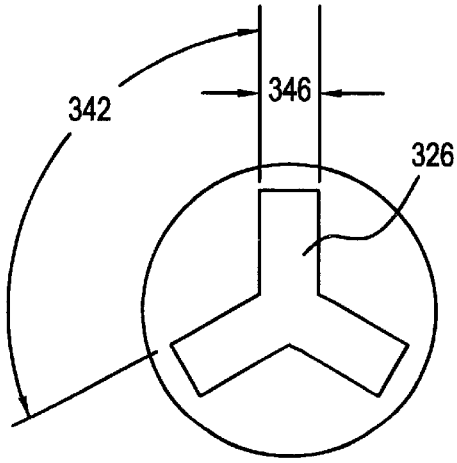

Referring to FIGS. 3*a* and 3*b*, a third foot portion 326 has a Y-shaped cross section. The dimensions of the third foot portion depend on dimensions of a third basin 330 and on the dimensions of a mating backup crucible (not shown). For example, a third basin height 334 influences a third foot portion height 338. Each leg of the Y is separated from a neighboring leg by a separation angle 342. A selected leg thickness 346 is a function of anticipated load and melting liner material selections. One possible exemplary design for a melting liner with a third basin height 334 of 9.5 inches calls for a third foot portion height 338 of 1.75 inches, a separation angle of 120 degrees, and a leg thickness 346 of 1 inch.

Figure 4A:
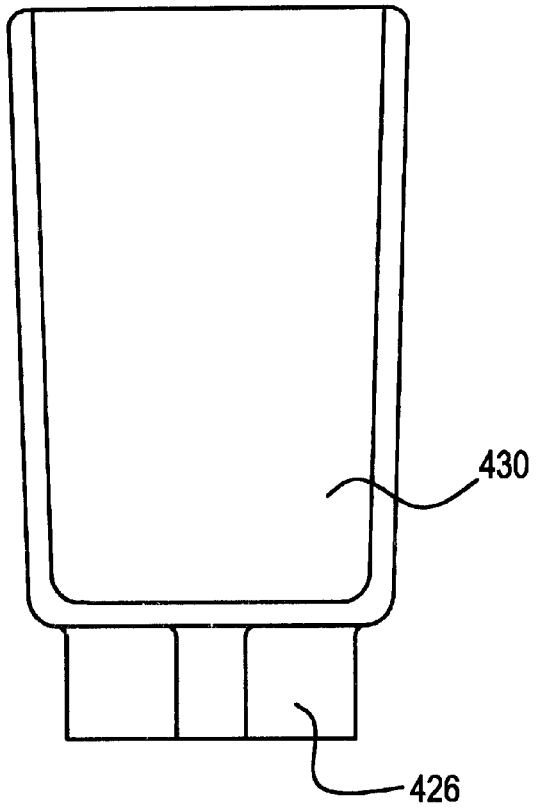
FIGS. 4*a* and 4*b* are an elevation and bottom view of a melting liner having a X-shaped foot portion.
Figure 4B:
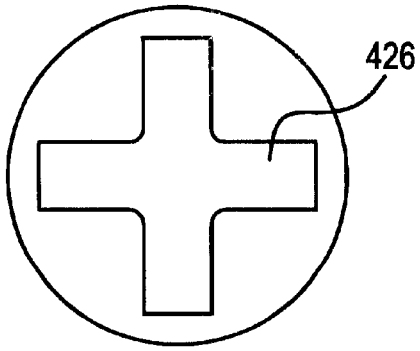

Referring to FIGS. 4*a* and 4*b*, a fourth foot portion 426 has an X-shaped cross section. The dimensions of the fourth foot portion depend on dimensions of a fourth basin 430 and on the dimensions of a mating backup crucible (not shown). For example, a fourth basin height 434 influences a fourth foot portion height 438. Each leg of the X-shaped foot is separated from a neighboring leg by a separation angle of, for example, about 90 degrees. A selected leg thickness 446 is a function of anticipated load and melting liner material selections. One possible exemplary design for a melting liner with a fourth basin height 434 of 9.5 inches, calls for a fourth foot portion height 438 of 1.75 inches, and a leg thickness 446 of 1 inch.

Figure 5A:
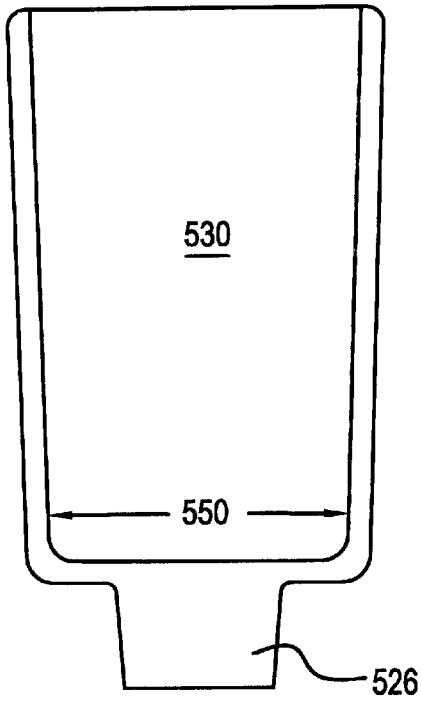
FIGS. 5*a* 5*b*, 5*c* and 5*d* are a front elevation, side elevation and two bottom views of a melting liner having a foot portion including two separate feet.
Figure 5C:
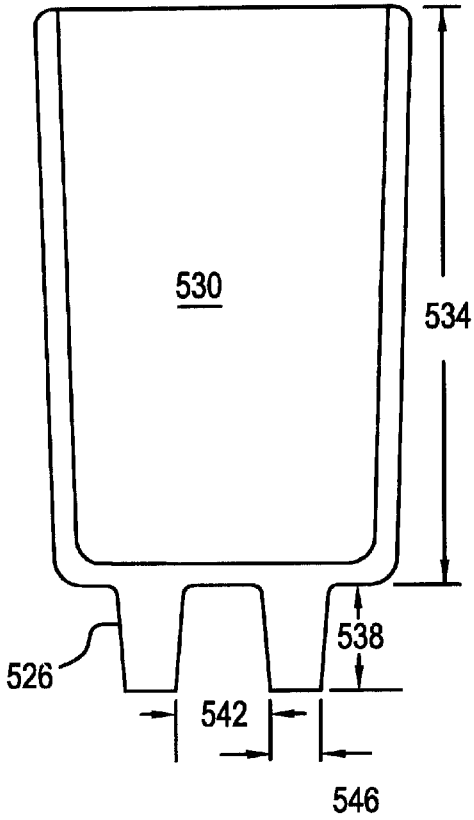
Figure 5B:
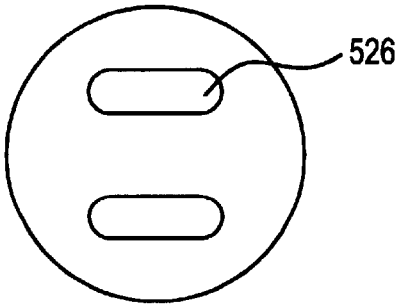
Figure 5D:
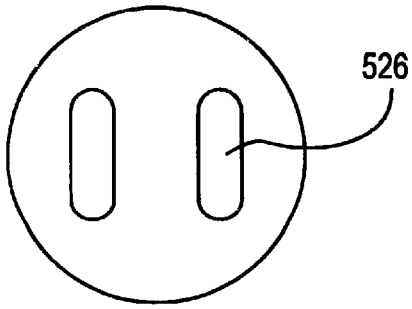

Referring to FIGS. 5*a* and 5*d*, a fifth foot portion 526 includes two separate feet. The dimensions of the fifth foot portion depend on dimensions of a fifth basin 530 and on the dimensions of a mating backup crucible (not shown). For example, a fifth basin height 534 influences a fifth foot portion height 538. The feet of the fifth foot portion 526 are separated from each other by a fifth foot separation distance 542. A selected leg thickness 546 and the fifth foot separation distance 542 are a function of anticipated load and melting liner material selections. One possible exemplary design for a melting liner with a fourth basin height 534 of 9.5 inches and a fifth basin width 550 of 4.533 inches calls for a fifth foot portion height 438 of 1.75 inches, and a leg thickness 446 of 1 inch.

Figure 6A:
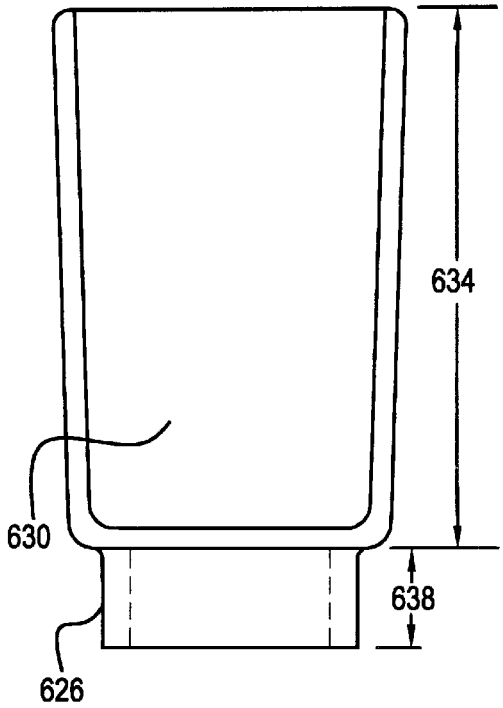
FIGS. 6*a* and 6*b* are an elevation and bottom view of a melting liner having a foot portion with a circular cross section.
Figure 6B:
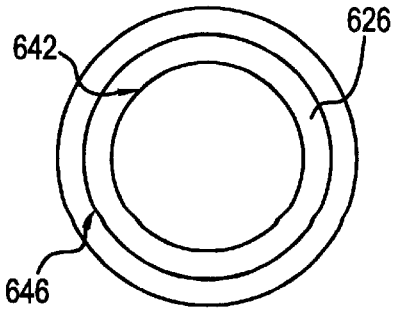

Referring to FIGS. 6*a* and 6*b*, a sixth foot portion 626 has a circular cross section. The dimensions of the sixth foot portion depend on dimensions of a sixth basin 630 and on the dimensions of a mating backup crucible (not shown). For example, a sixth basin height 634 influences a sixth foot portion height 638. The circular sixth foot portion 626 has a selected inner diameter 642 and outer diameter 646. The selected inner diameter 642 and outer diameter 646 are a function of anticipated load and melting liner material selections. One possible exemplary design for a melting liner with a sixth basin height 634 of 9.5 inches, calls for a sixth foot portion height 638 of 1.75 inches, an inner diameter 642 of 3.25 inches and an outer diameter 646 of 4.25 inches.

Figure 7A:
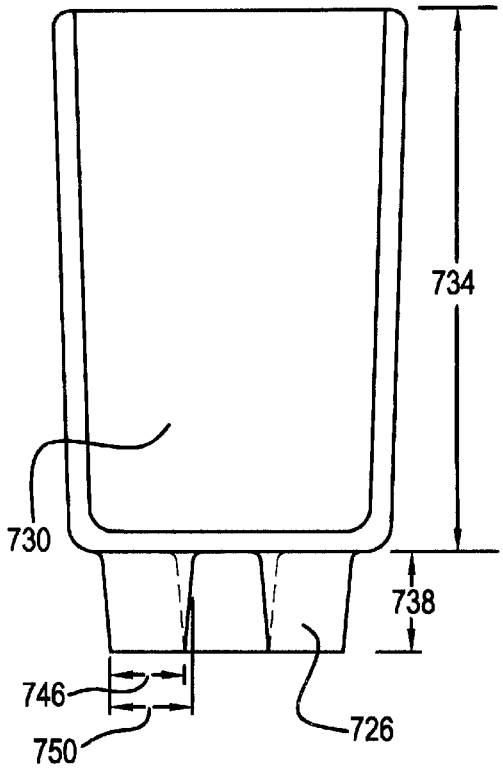
FIGS. 7*a* and 7*b* are an elevation and a bottom view of a melting liner having a foot portion including three separate feet.
Figure 7B:
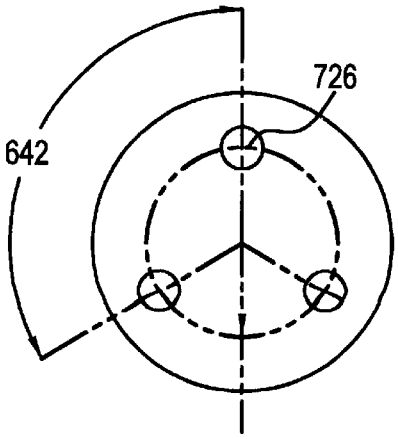

Referring to FIGS. 7*a* and 7*b*, a seventh foot portion 726 includes three separate feet. The dimensions of the fifth foot portion depend on dimensions of a seventh basin 730 and on the dimensions of a mating backup crucible (not shown). For example, a seventh basin height 734 influences a seventh foot portion height 738. The feet of the seventh foot portion 726 are separated from each other by a seventh foot separation angle 742. Each of the three feet has maximum thickness 746 and a minimum thickness 750 due to a taper. The maximum and minimum thicknesses 746, 750 are selected as a function of anticipated load and melting liner material selections. One possible exemplary design for a melting liner with a seventh basin height 734 of 9.5 inches, calls for a seventh foot portion height 738 of 1.75 inches, maximum leg thickness 746 of 1.483 inches and a minimum leg thickness of 1.25 inches.

The invention has been described with reference to particular embodiments. Modifications and alterations will occur to others upon reading and understanding this specification. For example, the numerical dimensions given are exemplary only. The invention may be embodied in much larger and much smaller melting liners. For example, basin heights of many feet are contemplated. The relative heights of the basin and foot portions may vary a drastically. For example, a basin may have a basin height of 1.75 inches while a foot portion has a foot portion height of 9.5 inches. It is intended that all such modifications and alterations are included insofar as they come within the scope of the appended claims or equivalents thereof.

What is claimed is:

1. In a furnace having a crucible installed therein, said crucible having an upper peripheral lip and an internal chamber having a bottom floor surface, and a melting liner received within said internal chamber of said crucible, said melting liner having a bottom surface sitting on said bottom floor surface of said crucible and said melting liner having an upper peripheral lip extending above said upper peripheral lip of said crucible, said upper peripheral lip of said melting liner being radially inward of said peripheral lip of said crucible, and said melting liner having an internal chamber having a first volume capacity, the improvement comprising a replacement melting liner adapted to replace said melting liner within said crucible, said replacement melting liner having an internal chamber having a second volume capacity less than said first volume capacity, said replacement melting liner having a bottom spaced from said bottom floor surface of said crucible by a foot portion attached to said replacement melting liner and extending downwardly from said bottom of said replacement melting liner, said foot portion having a bottom sitting on said bottom floor surface of said crucible, said replacement melting liner having an upper peripheral lip extending above and radially inward of said upper peripheral lip of said crucible when said foot portion bottom is engaging said bottom floor surface of said crucible.

2. The combination of claim 1, wherein said bottom of said replacement melting liner has an outer periphery, said foot portion being spaced radially inward from said outer periphery of said replacement liner bottom.

3. The combination of claim 1, wherein said replacement melting liner is made of a poured refractory material.

4. The melting liner of claim 2 wherein the foot portion comprises a Y-shaped cross section.

5. The melting liner of claim 2 wherein the foot portion comprises a X-shaped cross section.

6. The melting liner of claim 2 wherein the foot portion comprises a circular cross section.

7. The melting liner of claim 2 wherein the foot portion comprises two separate feet.

8. The melting liner of claim 2 wherein the foot portion comprises three separate feet.

* * * * *